US010334879B2

(12) United States Patent
Barkley

(10) Patent No.: US 10,334,879 B2
(45) Date of Patent: Jul. 2, 2019

(54) METHOD AND APPARATUS FOR METERING AND VAPORIZING A FLUID

(71) Applicant: Funai Electric Co., Ltd., Osaka (JP)

(72) Inventor: Lucas D. Barkley, Lexington, KY (US)

(73) Assignee: FUNAI ELECTRIC CO., LTD (JP)

( * ) Notice: Subject to any disclaimer, the term of this patent is extended or adjusted under 35 U.S.C. 154(b) by 488 days.

(21) Appl. No.: 14/976,053

(22) Filed: Dec. 21, 2015

(65) Prior Publication Data

US 2017/0172206 A1 Jun. 22, 2017

(51) Int. Cl.

| | |
|---|---|
| ***A24F 47/00*** | (2006.01) |
| ***F04B 19/00*** | (2006.01) |
| ***F04B 19/24*** | (2006.01) |
| ***F22B 1/28*** | (2006.01) |
| ***H05B 1/02*** | (2006.01) |
| ***H05B 3/03*** | (2006.01) |
| ***H05B 3/26*** | (2006.01) |

(52) U.S. Cl.

CPC ..... *A24F 47/008* (2013.01); *F04B 19/006* (2013.01); *F04B 19/24* (2013.01); *F22B 1/287* (2013.01); *H05B 1/0297* (2013.01); *H05B 3/26* (2013.01); *H05B 2203/013* (2013.01); *H05B 2203/021* (2013.01); *H05B 2203/022* (2013.01)

(58) Field of Classification Search

None

See application file for complete search history.

(56) References Cited

U.S. PATENT DOCUMENTS

| | | | | |
|---|---|---|---|---|
| 4,638,337 | A | 1/1987 | Torpey et al. | |
| 5,599,502 | A | 2/1997 | Myazaki et al. | |
| 5,874,974 | A | 2/1999 | Courian et al. | |
| 5,946,012 | A | 8/1999 | Courian et al. | |
| 6,094,207 | A * | 7/2000 | Wen | B41J 2/14 346/140.1 |
| 6,097,406 | A * | 8/2000 | Lubinsky | B41J 2/211 347/15 |
| 6,227,640 | B1 | 5/2001 | Maze et al. | |
| 6,247,779 | B1 | 6/2001 | Nowell, Jr. et al. | |
| 6,379,929 | B1 * | 4/2002 | Burns | B01J 19/0093 435/91.1 |
| 6,655,924 | B2 | 12/2003 | Ma | |
| 7,065,907 | B2 | 6/2006 | Valiyambath | |
| 7,284,839 | B2 | 10/2007 | Silverbook | |
| 8,891,949 | B2 | 11/2014 | Hong et al. | |
| 8,893,726 | B2 | 11/2014 | Hon | |
| 8,936,945 | B2 * | 1/2015 | Handique | B01F 5/061 436/180 |
| 9,364,833 | B2 * | 6/2016 | Bergstedt | B01L 7/525 |
| 2002/0054191 | A1 * | 5/2002 | Moon | B41J 2/14129 347/56 |

(Continued)

FOREIGN PATENT DOCUMENTS

| | | |
|---|---|---|
| JP | 09196302 | 7/1997 |
| JP | 200461010 | 2/2004 |

*Primary Examiner* — Ibrahime A Abraham

*Assistant Examiner* — Gyounghyun Bae

(74) *Attorney, Agent, or Firm* — Ludeka Neely Group, PC

(57) ABSTRACT

A vaporization device, including a fluid supply containing a vaporizable fluid; a bubble pump operative to pump fluid from the fluid supply to an outlet of the bubble pump; and a fluid vaporization heater located adjacent the outlet of the bubble pump to receive fluid from the bubble pump.

19 Claims, 5 Drawing Sheets

(56) References Cited

U.S. PATENT DOCUMENTS

| | | | | |
|---|---|---|---|---|
| 2003/0086790 | A1* | 5/2003 | Ma | F04B 19/24 417/209 |
| 2003/0175947 | A1* | 9/2003 | Liu | B01F 11/0071 435/288.5 |
| 2003/0215335 | A1* | 11/2003 | Crivelli | B01F 5/0415 417/53 |
| 2004/0086816 | A1 | 5/2004 | Hays et al. | |
| 2005/0019180 | A1* | 1/2005 | Seto | F04B 23/06 417/413.1 |
| 2005/0157089 | A1* | 7/2005 | Bell | B41J 2/14129 347/62 |
| 2008/0115359 | A1* | 5/2008 | Guan | B41J 2/1404 29/890.1 |
| 2012/0007921 | A1* | 1/2012 | Govyadinov | B41J 2/1404 347/54 |
| 2012/0207625 | A1* | 8/2012 | McNamara | F04B 19/24 417/207 |
| 2013/0048254 | A1* | 2/2013 | Livingston | H01L 23/427 165/104.29 |
| 2014/0051161 | A1* | 2/2014 | Bergstedt | B01L 7/525 435/303.1 |
| 2014/0060554 | A1* | 3/2014 | Collett | H05B 3/265 131/328 |
| 2016/0007653 | A1 | 1/2016 | Tu | |
| 2016/0103104 | A1* | 4/2016 | Gianchandani | B01L 3/502707 73/23.41 |
| 2016/0138795 | A1 | 5/2016 | Meinhart et al. | |
| 2016/0338407 | A1* | 11/2016 | Kerdemelidis | A24F 47/008 |
| 2017/0043600 | A1* | 2/2017 | Abbott, Jr. | F25B 21/00 |
| 2017/0167481 | A1* | 6/2017 | Bergstedt | F04B 49/065 |
| 2018/0021777 | A1* | 1/2018 | Giri | B01L 3/502715 |

* cited by examiner

METHOD AND APPARATUS FOR METERING AND VAPORIZING A FLUID

FIELD

This disclosure relates generally to methods and apparatus for metering and vaporizing a fluid. More particularly, this disclosure relates to fluid vaporization structures that utilize a bubble pump to transport fluid to a vaporization structure.

BACKGROUND

Improvement is desired in the field of microfluidic structures of the type used to dispense a solution from a storage supply to another device where a secondary function may be performed. An example of one secondary function is vaporization of the solution using a heater such that the contents of the solution can be delivered to complete its function in a gaseous state. Such microfluidic structures have many applications, such as for providing vapor therapy, flavored e-cigarettes, chemical vapor reactions, and the like.

Conventional structures for dispensing fluid from a fluid supply to a vaporization heater structure desire improvement. For example, conventional devices are often unreliable in providing consistent and desired amounts of fluid to the vaporization heater structure. As part of this, clogging of the flow path and causes of incomplete travel of fluid are common, resulting in uncertainty of the amount of fluid that reaches the vaporizing element.

The disclosure advantageously provides improved apparatus and methods for metering and vaporizing fluids.

SUMMARY

The present disclosure relates to methods and apparatus for metering and vaporizing fluids.

In one aspect, there is disclosed a vaporization device, including a fluid supply containing a vaporizable fluid; a bubble pump operative to pump fluid from the fluid supply to an outlet of the bubble pump; and a fluid vaporization heater located adjacent the outlet of the bubble pump to receive fluid from the bubble pump. The vaporization heater is operative to heat and thereby vaporize the received fluid.

In another aspect, there is disclosed a vaporization device, including a fluid supply containing a vaporizable fluid; a bubble pump having an inlet in flow communication with the fluid supply for receiving fluid therefrom, a fluid flow path, flow sequencing heaters located within the fluid flow path, and an outlet. The bubble pump is operative to pump fluid from the fluid supply to the outlet of the bubble pump. A fluid vaporization heater is located adjacent the outlet of the bubble pump. The fluid vaporization heater has a heated fluid contact surface to receive fluid from the outlet of the bubble pump and to heat and thereby vaporize the received fluid.

In a further aspect, there is disclosed a method of vaporizing fluid. The method includes the steps of: providing a fluid supply containing a vaporizable fluid; providing a bubble pump in fluid communication with the fluid supply and operating the bubble pump to pump fluid from the fluid supply to an outlet of the bubble pump; and providing a fluid vaporization heater adjacent the outlet of the bubble pump to receive fluid from the bubble pump, and operating the vaporization heater to heat and thereby vaporize the received fluid.

BRIEF DESCRIPTION OF THE DRAWINGS

Further advantages of the disclosure are apparent by reference to the detailed description in conjunction with the figures, wherein elements are not to scale so as to more clearly show the details, wherein like reference numbers indicate like elements throughout the several views, and wherein.

DETAILED DESCRIPTION

The disclosure relates to fluid vaporization structures that utilize one or more bubble pumps to transport fluid from one or more fluid supplies to a discrete fluid vaporization structure.

Figure 1:
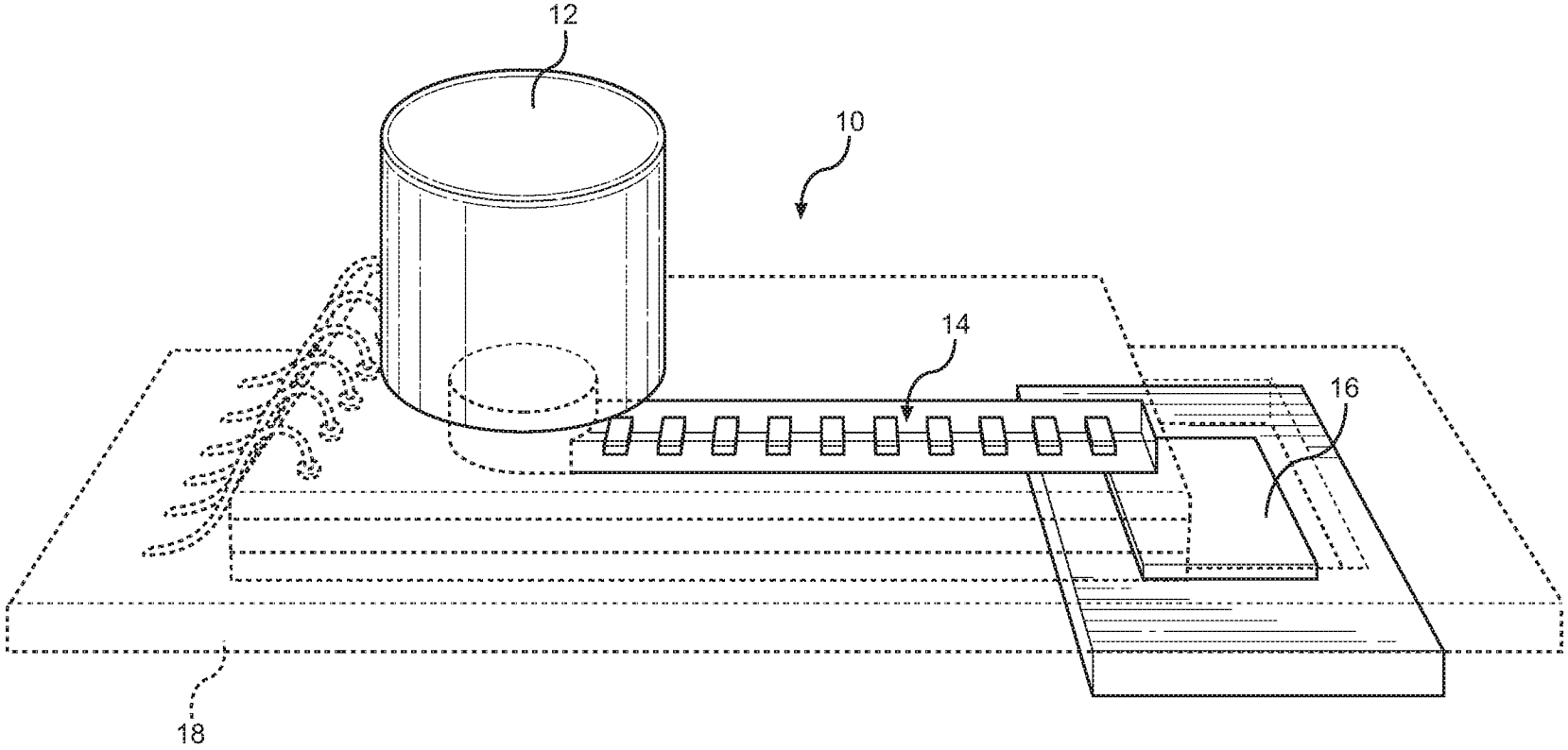
FIGS. 1-3 show a fluid vaporization device according to the disclosure in which a vaporizer is located in a plane substantially parallel to a plane defined by a bubble pump.
Figure 2:
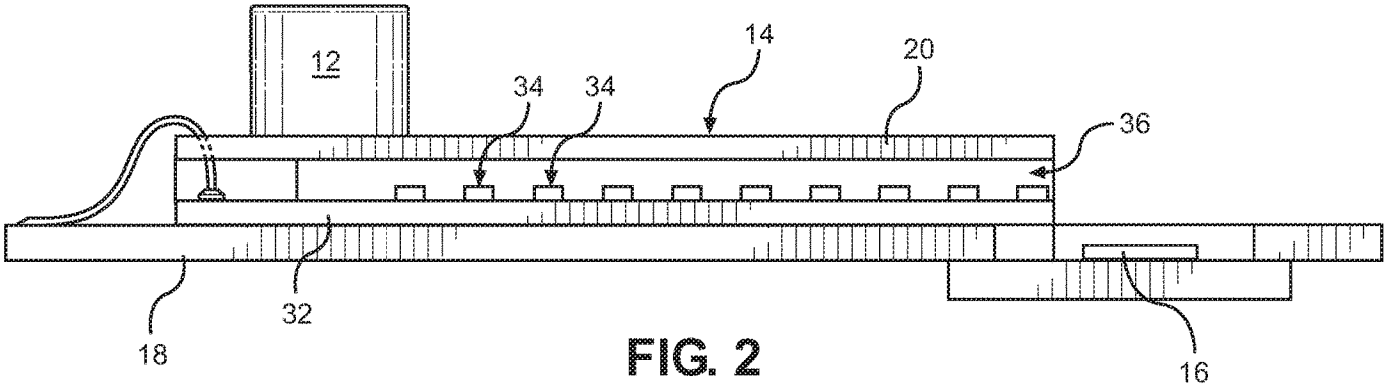
Figure 3:
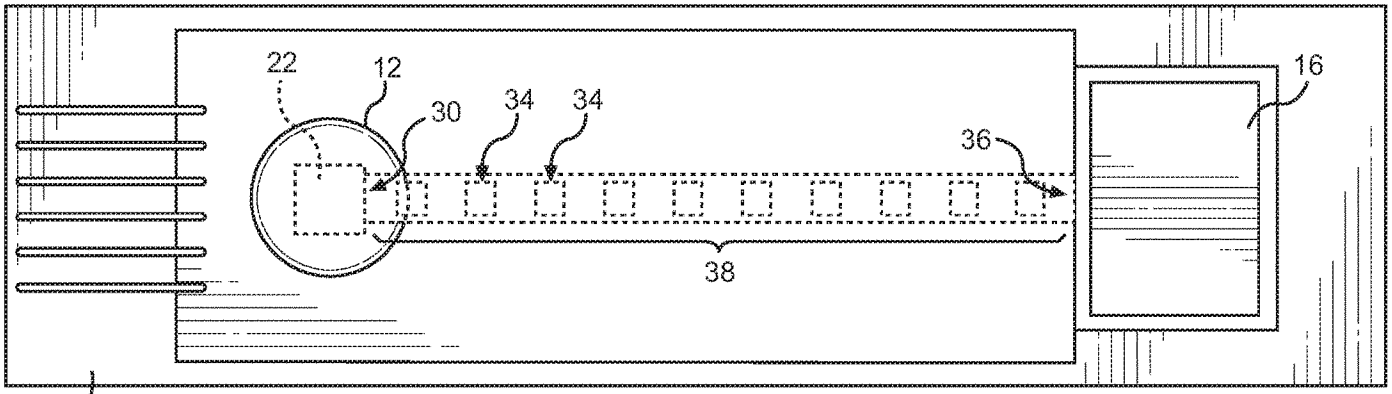

With reference to FIGS. 1-3, there is shown a fluid vaporization device 10 having a fluid supply 12, a bubble pump 14, and a vaporizer 16. The device 10 is configured so that the bubble pump 14 desirably transports fluid from the fluid supply 12 directly onto the vaporizer 16.

The device 10 is incorporated onto a printed circuit board 18 to provide a single assembly containing the fluid supply 12, the bubble pump 14, and the vaporizer 16. The bubble pump 14 has a length axis that generally defines a plane, and the vaporizer is provided on a substrate generally defining a plane. As will be noted, in the embodiment of FIGS. 1-3, the plane defined by the bubble pump 14 and the plane defined by the vaporizer 16 are substantially parallel to one another.

The fluid supply 12 is configured as a fluid storage vessel located on a cover substrate 20 of the bubble pump 14. The fluid supply 12 is charged with a desired vaporizable fluid and is generally vented to the atmosphere and contains a desired volume of a fluid, typically a liquid at ambient conditions. As one example, the fluid may be a liquid of a type utilized for vapes or e-cigarettes in a volumetric amount suitable for such usage. A supply inlet 22 is defined between the fluid supply 12 and the cover substrate 20 to provide a fluidic path for desired travel of fluid from the fluid supply 12 to the bubble pump 14.

The bubble pump 14 is configured for pumping fluid from the fluid supply 12 to the vaporizer 16. In addition to the cover substrate 20, the bubble pump 14 includes an inlet 30, a base substrate 32, flow sequencing resistive heaters 34, and an outlet 36. During manufacture, a flow feature layer is initially deposited on the base substrate 32. The flow feature layer is then selectively etched to provide the heaters 34 and to define a flow channel 38.

The base substrate 32 may be a semiconductor silicon substrate that is suitable for providing bubble pumps and logic circuits thereon. The cover substrate 20 may be made of silicon or a polymeric material such as polyimide. The resistive heaters 34 and vaporizer 16 may be made of TaAlN, TaAl or other thin film resistor material. The preferred material for the flow feature layer for providing the resistive heaters 34 is TaAlN deposited on the base substrate 32 as by sputtering. The vaporizer 16 may be formed in a similar manner.

Electrical connections and logic circuits are integrated onto the device 10 to control and operate the heaters 34 of the bubble pump 14 and the vaporizer 16, and to otherwise control the transfer of fluid from the fluid supply 12 to the vaporizer 16. For example, voltage pulses may be applied to the heaters 34 in a desired manner to form and transport thermal bubbles of the fluid along the flow channel 38 to deliver fluid as desired to the vaporizer 16 for vaporization of the delivered fluid. Examples of preferred bubble pumps are shown in U.S. Pat. No. 8,891,949, issued Nov. 18, 2014, entitled Micro-fluidic pump, and incorporated by reference herein in its entirety.

In basic operation of the bubble pump 14, a voltage pulse is applied to each of the heaters 34 in sequence to generate thermal bubbles in a predetermined manner. For example, every heater 34 can form a bubble from the inlet 30 to the outlet 36 of the channel 38 in sequence to transport fluid as desired from the supply 12 to the vaporization heater 16. Each heater 34 is also desirably permitted to cool down before the next firing sequence in order to prevent overheating and boiling of fluid within the bubble bump 14.

The vaporizer 16 is configured as a microfluidic electrical heating element designed specifically to vaporize the fluid received from the fluid supply 12. The vaporizer 16 is located adjacent and below the outlet 36 of the bubble pump 14. A slot or other flow path is formed through the circuit board 18 for travel of fluid from the outlet 36 of the bubble pump 14 to the vaporizer 16. The vaporizer 16 has a heated fluid contact surface that is open and exposed to the air or other local environment. The heated fluid contact surface heats the received fluid to vaporize the received fluid into the atmosphere or other local environment.

Figure 4:
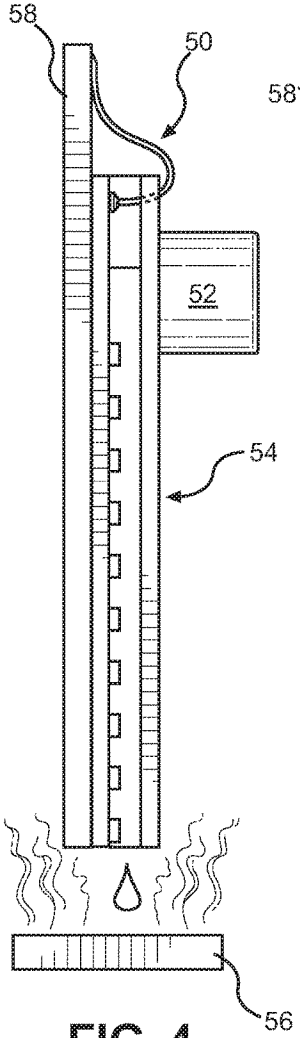
FIG. 4 shows an alternate embodiment of fluid vaporization device in which a vaporizer is located in a plane substantially perpendicular to a plane defined by a bubble pump.

Turning now to FIG. 4, there is shown an alternate embodiment of a fluid vaporization device 50. The device 50 has a fluid supply 52, a bubble pump 54, and a vaporizer 56. The fluid supply 52 and the bubble pump 74 are incorporated onto a printed circuit board 58. The fluid supply 52, the bubble pump 54, and the vaporizer 56 substantially correspond to the fluid supply 12, the bubble pump 14, and the vaporizer 16. However, the vaporizer 56 is spaced from the end of the circuit board 58 so as to be in a plane that is substantially perpendicular to a fluid flow plane defined by the bubble pump 54.

Figure 6:
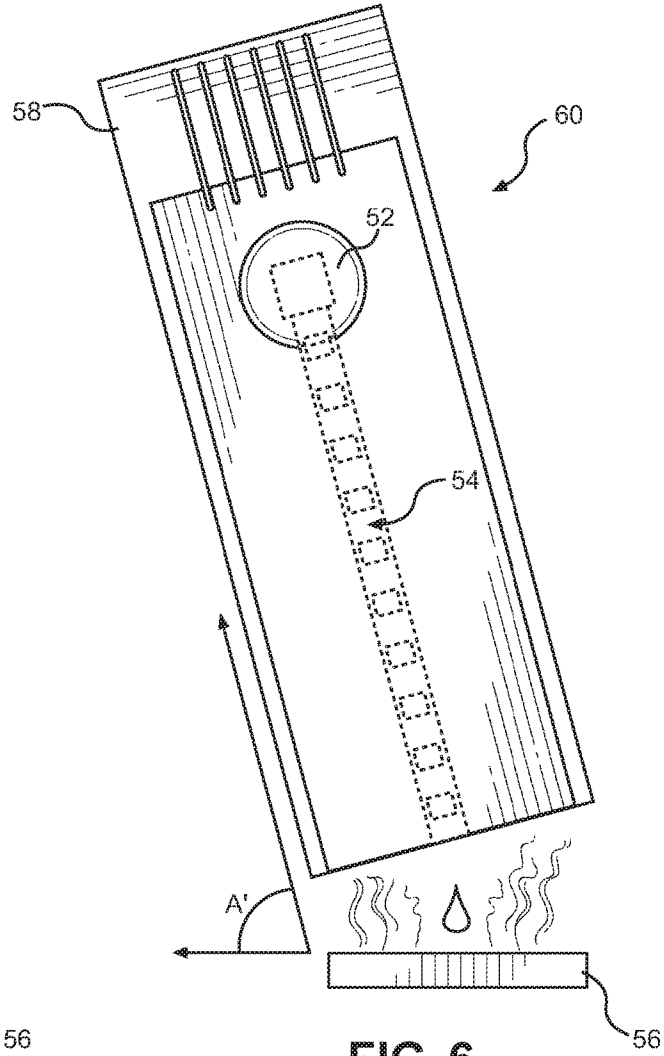
FIGS. 5 and 6 show yet another alternate embodiment of fluid vaporization device in which an angle between a plane defined by vaporizers and a plane defined by a bubble pumps is varied.
Figure 5:
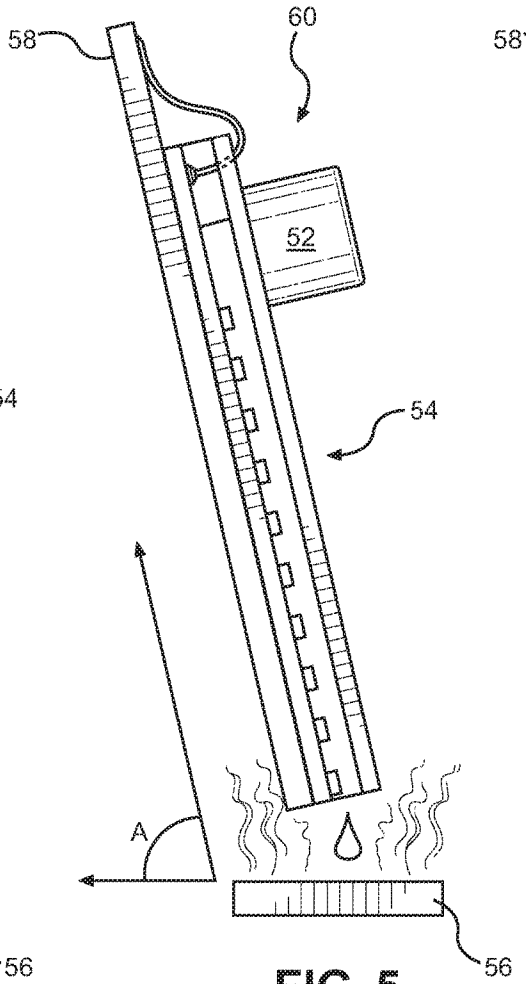

Turning now to FIGS. 5 and 6, there is shown another alternate embodiment of a fluid vaporization device 60. The device 60 substantially corresponds to the device 50, and includes the fluid supply 52, bubble pump 54, and the vaporizer 56, except the circuit board 58 with the bubble pump 54 thereon is oriented at an angle A or an angle A' or both relative to a plane defined by the vaporizer 56. The angles A and A' may each vary from about 0 degrees to about 90 degrees. In this regard, it will be appreciated that the depicted angles are provided to show that the angular orientation between the bubble pump 54 and the vaporizer 56 may be varied in any of the three dimensions.

Figure 7:
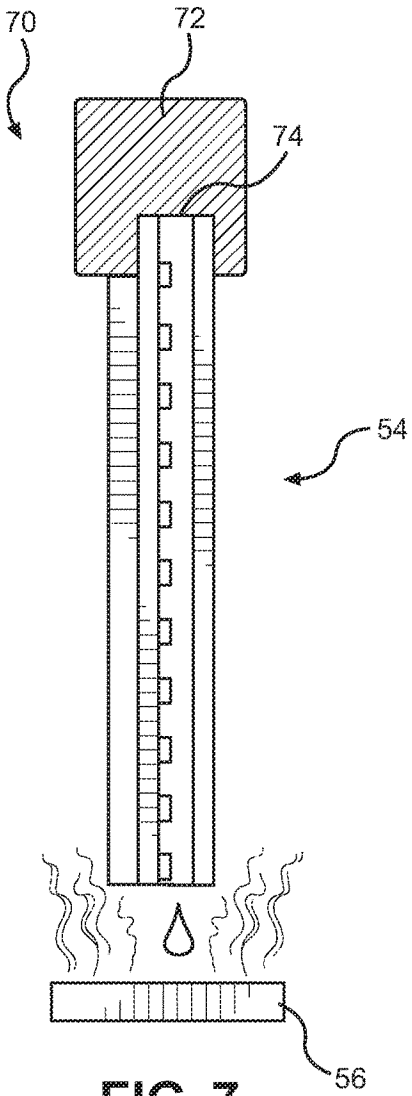
FIG. 7 shows a further embodiment of a fluid vaporization device having a fluid supply inlet located at an edge of the device.

Turning now to FIG. 7, there is shown yet another embodiment of a fluid vaporization device 70. The device 70 substantially corresponds to the device 50, and includes the bubble pump 54, the vaporizer 56 and the circuit board 58. However, a fluid supply 72 is provided having an inlet 74 located at a distal end of the assembly of the bubble pump 54 and the circuit board 58 opposite the vaporizer 56.

Figure 8:
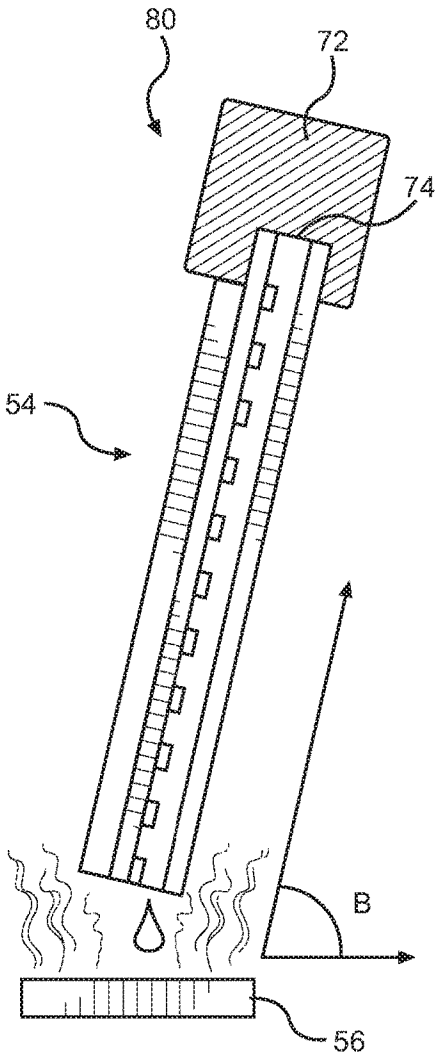
FIG. 8 shows a still further embodiment of a fluid vaporization device having a fluid supply inlet located at an edge of the device, with an angle between a plane defined by a vaporizer and a plane defined by a bubble pump of the device is varied.

Turning now to FIG. 8, there is shown another alternate embodiment of a fluid vaporization device 80. The device 60 substantially corresponds to the device 70, and includes the fluid supply 72, bubble pump 54, and the vaporizer 56, except the circuit board 58 with the bubble pump 54 thereon is oriented at an angle B relative to the plane defined by the vaporizer 56. The angle B may vary from about 0 degrees to about 90 degrees. As in the case of the device 60, the angle B may be in one or more dimensions, as explained in connection with the angles A and A' of FIGS. 5 and 6.

Figure 9:
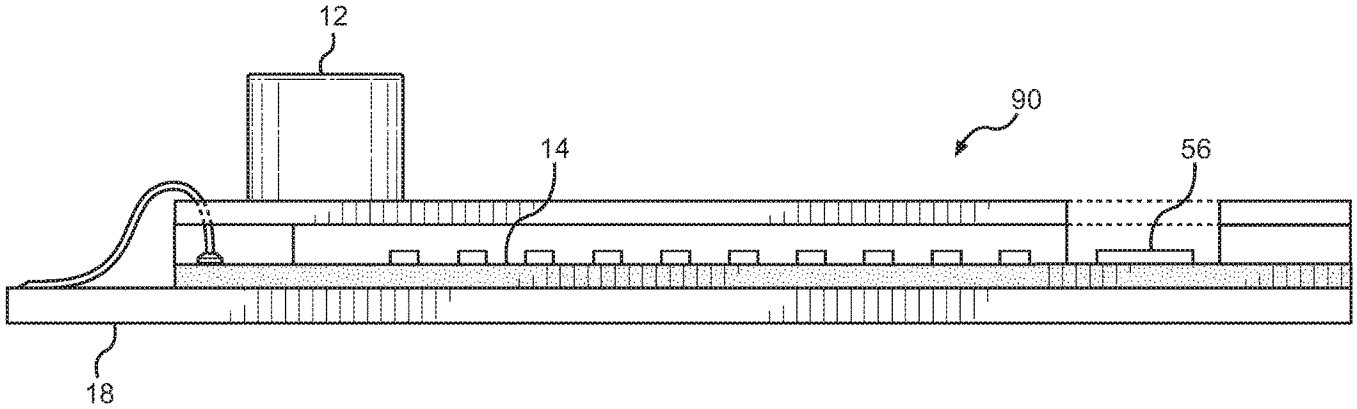
FIGS. 9 and 10 show another embodiment of a fluid vaporization device in which the bubble pump and the vaporizer are fabricated on the same substrate.
Figure 10:
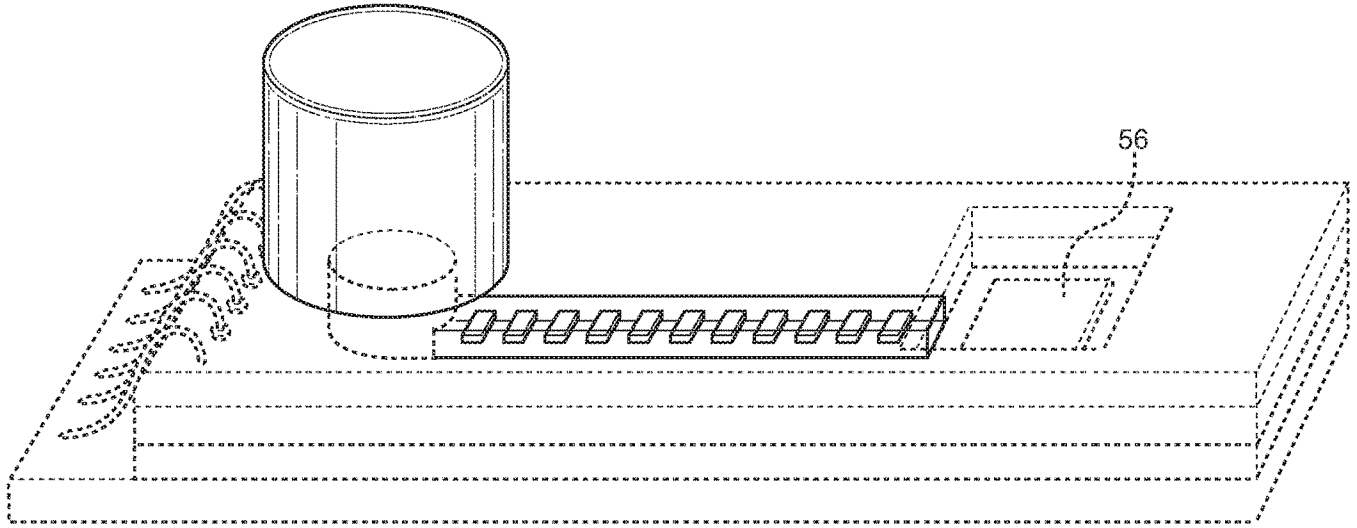

Turning now to FIGS. 9 and 10 there is shown another alternate embodiment of a fluid vaporization device 90. The device 90 substantially corresponds to the device 10, and includes the fluid supply 12, the bubble pump 14, the vaporizer 16, and the circuit board 18. However, the device 90 is constructed with the bubble pump 14 and the vaporizer 16 fabricated on the same substrate.

The foregoing description of preferred embodiments for this disclosure has been presented for purposes of illustration and description. The description and embodiments are not intended to be exhaustive or to limit the disclosure to the precise forms disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A vaporization device, comprising:

a fluid supply containing a vaporizable fluid;

a bubble pump having an inlet in flow communication with the fluid supply for receiving the vaporizable fluid therefrom, a fluid flow path, flow sequencing heaters located within the fluid flow path, and an outlet, wherein the bubble pump is operative to pump the vaporizable fluid from the fluid supply to the outlet of the bubble pump; and a planar fluid vaporization heater made of a thin film resistor material, the vaporization heater being separate from the bubble pump located adjacent to the outlet of the bubble pump, wherein the fluid supply and the bubble pump are incorporated onto a printed circuit board, the fluid vaporization heater having a heated fluid contact surface to receive the vaporizable fluid from the outlet of the bubble pump and to heat and thereby vaporize the received fluid into the atmosphere.

2. The vaporization device of claim 1, wherein the bubble pump and the fluid vaporization heater are located on parallel planes.

3. The vaporization device of claim 1, wherein the bubble pump and the fluid vaporization heater are located on perpendicular planes.

4. The vaporization device of claim 1, wherein an angular position of the bubble pump relative to the fluid vaporization heater is variable.

5. The vaporization device of claim 1, wherein the bubble pump and the fluid vaporization heater are fabricated on a common substrate.

6. The vaporization device of claim 1, wherein the bubble pump and the fluid vaporization heater are fabricated on different substrates.

7. The vaporization device of claim 1, wherein the fluid supply is located vertically above the bubble pump.

8. The vaporization device of claim 1, wherein the fluid vaporization heater is incorporated onto the printed circuit board.

9. The vaporization device of claim 8, wherein the fluid supply has an inlet located at an end of the printed circuit board opposite the fluid vaporization heater.

10. A vaporization device, comprising:

a fluid supply containing a vaporizable fluid; a bubble pump operative to pump the vaporizable fluid from the fluid supply to an outlet of the bubble pump; and a planar fluid vaporization heater made of a thin film resistor material, the vaporization heater being separate from the bubble pump located adjacent to the outlet of the bubble pump to receive the vaporizable fluid from the bubble pump, wherein the fluid supply and the bubble pump are incorporated onto a printed circuit board, the fluid vaporization heater being operative to heat and thereby vaporize the received fluid into the atmosphere.

11. The vaporization device of claim 10, wherein the bubble pump and the fluid vaporization heater are located on parallel planes.

12. The vaporization device of claim 10, wherein the bubble pump and the fluid vaporization heater are located on perpendicular planes.

13. The vaporization device of claim 10, wherein an angular position of the bubble pump relative to the fluid vaporization heater is variable.

14. The vaporization device of claim 10, wherein the bubble pump and the fluid vaporization heater are fabricated on a same substrate.

15. The vaporization device of claim 10, wherein the bubble pump and the fluid vaporization heater are fabricated on different substrates.

16. The vaporization device of claim 10, wherein the fluid supply is located vertically above the bubble pump.

17. The vaporization device of claim 10, wherein the fluid vaporization heater is incorporated onto the printed circuit board.

18. The vaporization device of claim 17, wherein the fluid supply has an inlet located at an end of the printed circuit board opposite the fluid vaporization heater.

19. A method of vaporizing fluid, comprising the steps of:

providing a fluid supply containing a vaporizable fluid; providing a bubble pump in fluid communication with the fluid supply and operating the bubble pump to pump the vaporizable fluid from the fluid supply to an outlet of the bubble pump; providing a planar fluid vaporization heater made of a thin film resistor material, the vaporization heater being separate from the bubble pump adjacent to the outlet of the bubble pump to receive the vaporizable fluid from the bubble pump, wherein the fluid supply and the bubble pump are incorporated onto a printed circuit board, and operating the fluid vaporization heater to heat and thereby vaporize the received fluid into the atmosphere.

* * * * *